United States Patent [19]

Provost

[11] 4,056,200

[45] Nov. 1, 1977

[54] HIGH SPEED STACKER

[75] Inventor: Richard H. Provost, Brimfield, Mass.

[73] Assignee: Package Machinery Company, East Longmeadow, Mass.

[21] Appl. No.: 699,512.

[22] Filed: June 24, 1976

[51] Int. Cl.[2] ..... B65G 57/00

[52] U.S. Cl. ..... 214/7; 53/159; 271/178

[58] Field of Search ..... 214/6.5, 7; 271/178, 271/181, 184, 185, 187, 214; 53/159, 254; 198/480, 481, 608

[56] References Cited

U.S. PATENT DOCUMENTS

| | | | |
|---|---|---|---|
| 2,003,519 | 6/1935 | Schnaier | 214/7 |
| 2,421,874 | 6/1947 | Fouse | 217/187 X |
| 2,797,098 | 6/1957 | Brodie | 214/7 X |
| 3,086,334 | 4/1963 | Griner et al. | 53/159 X |
| 3,337,064 | 8/1967 | Mojden et al. | 214/7 |
| 3,416,286 | 12/1968 | Ciccone | 214/7 X |
| 3,866,905 | 2/1975 | Trogan et al. | 214/7 X |

*Primary Examiner*—L. J. Paperner

*Attorney, Agent, or Firm*—McCormick, Paulding & Huber

[57] ABSTRACT

A high speed stacker for grouping small tablets or similar products utilizes a vertically oriented tumble wheel having peripheral pockets for carrying the products serially between a receiving point and a discharge point. At the discharge point, the products are unloaded onto a stacking tray by means of a pair of stacking wheels on opposite axial sides of the tumble wheel. The stacking wheels are driven rotatably in opposite directions about axes lying in a plane generally tangent to the tumble wheel at the discharge point. The stacking tray immediately below the wheels receives the discharged products in series from the stacking wheels and holds them in a stack on a support surface of the tray.

10 Claims, 3 Drawing Figures

HIGH SPEED STACKER

BACKGROUND OF THE INVENTION

The present invention relates to product handling machinery such as packaging machinery and relates more particularly to stackers such as used in packaging machinery for grouping products together prior to envelopment in a wrapper.

Numerous designs for product stackers in packaging machinery are known from the prior art. U.S. Pat. Nos. 2,276,744 and 3,086,334 disclose stackers for grouping various products fed to the stacker in series. In the earlier patent, sticks of gum are assembled in groups of five by a stacker and then enveloped in a single wrapper to produce the package sold on the retail market. The stacker receives the sticks of gum serially in a horizontal position and develops a vertical pile or stack of the sticks by inserting the serially fed sticks one under the other. Then the stack is displaced into a wrapper positioned in the path of the stack and the wrapper is folded around the stack in a tumble box.

In U.S. Pat. No. 3,086,334 a stacker is disclosed which functions as a metering apparatus for collecting individual baked goods such as cookies and the like in numerically similar, horizontal stacks, that is stacks in which the products stand directly on a support surface in side by side contact.

It is a general object of the present invention to disclose a stacker for grouping products in horizontal stacks when the products are received, and correspondingly, discharged at relatively high rates.

SUMMARY OF THE INVENTION

The present invention resides in a high speed stacker for assembling a group of individual products in a closely packed series. The invention has particular utility in packaging machinery in which the grouped products are individually fed to the stacker in a wrapped or unwrapped state for grouping and eventual development of a single package from each group.

The stacker comprises an input feeding means for delivering the individual products sequentially along a product feed path. A tumble wheel is mounted along the feed path for rotation about a fixed axis with the wheel generally tangent to the path at a receiving point. The wheel contains a plurality of pockets distributed evenly about its periphery and each pocket has a peripheral opening for receiving the individual products transmitted to the wheel at the receiving point. The products are carried in the pockets along an arcuate path about the wheel to a discharge point situated remotely from the receiving point.

A stacking tray projects away from the periphery of the tumble wheel at the discharge point and defines a support surface for holding the discharged products in the desired stack.

To remove the products individually from the tumble wheel, two stacking wheels are positioned in spaced relationship and at opposite sides of the wheel at the discharge point. The wheels are driven rotatably in opposite directions about parallel axes lying in a plane generally parallel to the axis of rotation of the tumble wheel at the discharge point. Preferably, the parallel axes of the stacking wheels lie in a plane which is generally tangent to the tumble wheel at the discharge point. The stacking wheels cooperate with the tumble wheel and stacking tray by pulling the products out of the pockets on the tumble wheel and setting the products on the support surface of the stacking tray in side-by-side series relationship.

A feed mechanism for moving the stacked products along the tray may also be provided to advance the stacks further along in the packaging or other machinery.

Continuous rotation of the tumble wheel and stacking wheels permits a high volume of individual products to be assembled in groups of two, three or more in relatively brief periods of time.

DESCRIPTION OF THE PREFERRED EMBODIMENTS

Figure 1:
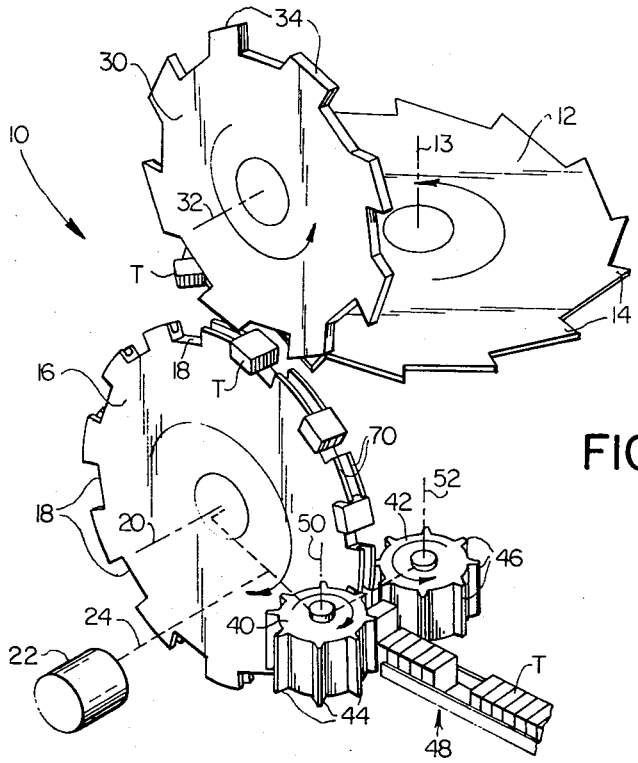
FIG. 1 is a perspective view illustrating the principal components of the high speed stacker of the present invention.

FIG. 1 illustrates the principal components of the high speed stacker of the present invention, generally designated 10. As illustrated, the stacker is adapted to receive individual rectangular products, such as tablets T, and discharge the products side-by-side in horizontally extending stacks. It should be understood, however, that the stacker may be used with a variety of products including food stuffs, small boxes and similar products in either wrapped or unwrapped form. The stacker in a typical environment may be situated at the discharging end of a wrapping machine such as illustrated and disclosed in co-pending patent application Ser. No. 699,518 filed on June 24, 1976 by Putnam et al and entitled "High Speed Wrapping Machine With Rotary Folder".

A feed wheel 12 rotated about a vertically oriented axis 13 and having an annular series of rachet teeth 14 delivers the tablets T serially along a feed path to a receiving point at the top of the tumble wheel 16. The tumble wheel 16 is generally tangent to the feed wheel 12 at the receiving point, and is provided with a series of product-receiving pockets 18 on its periphery. The tumble wheel is driven rotatably about a fixed horizontal axis 20 by means of a drive motor 22 and a drive train 24 illustrated schematically. A pressing wheel 30 situated directly above the tumble wheel 16 and rotating about an axis 32 parallel to the axis 20 is provided with peripheral projections 34 to urge the tablets individually out of engagement with the teeth 14 on the feed wheel 12 and into registering pockets 18 of the tumble wheel 16.

The tumble wheel 16 carries the tablet in an arcuate path from the receiving point at the mergence of the wheels 12 and 16 to a discharge point between two vertically oriented stacking wheels 40 and 42. The stacking wheels 40 and 42 have spaced peripheral teeth 44 and 46 respectively for pulling the tablets out of the pockets 18 on the tumble wheel and depositing the tablets in a horizontal stack on the stacking tray 48. For this purpose, the stacking wheels 40 and 42 are driven rotatably in synchronous relationship with the tumble wheel 16 and in opposite directions about their respective axes 50 and 52 by means of the motor 22 and the drive train 24. The directions of rotations of the wheels 12, 16, 30, 40 and 42 are illustrated by arrows and although the drive train 24 is shown connected only to the tumble wheel 16 and the stacking wheels 40 and 42, it should be understood that in a preferred embodiment, the motor 22 would be connected by the drive train to all of the wheels to ensure that they rotate synchronously together.

Figure 2:
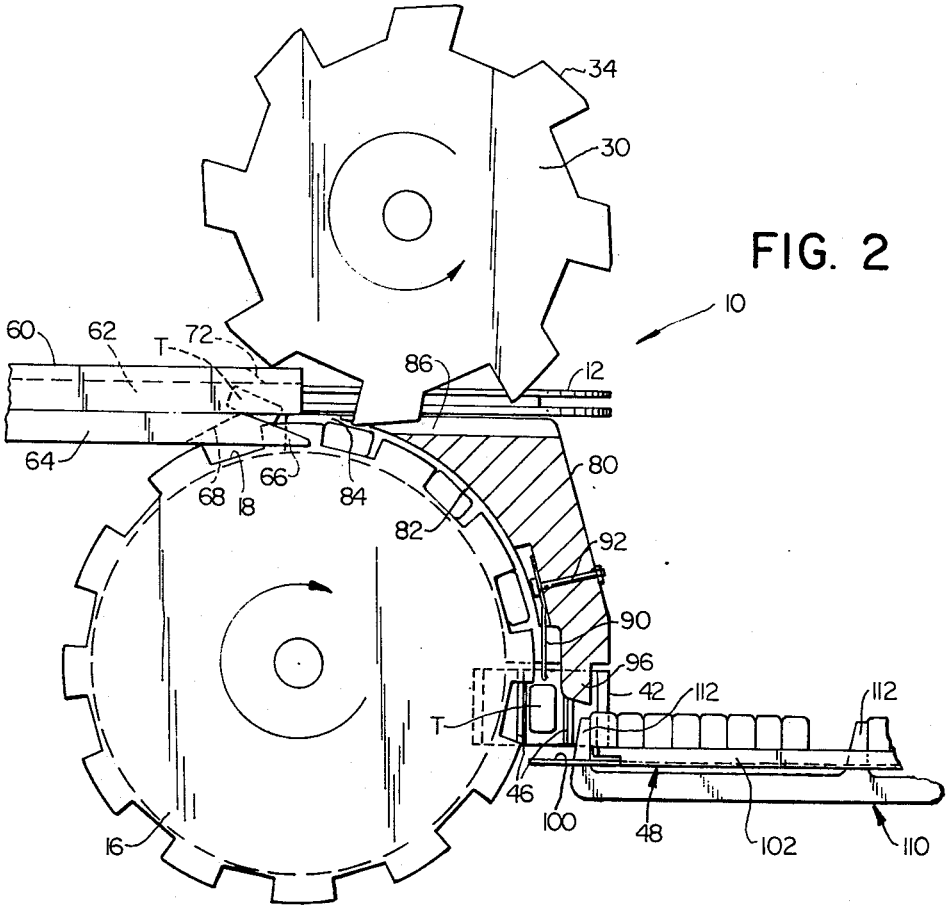
FIG. 2 is an elevation view of the high speed stacker partially in section.
Figure 3:
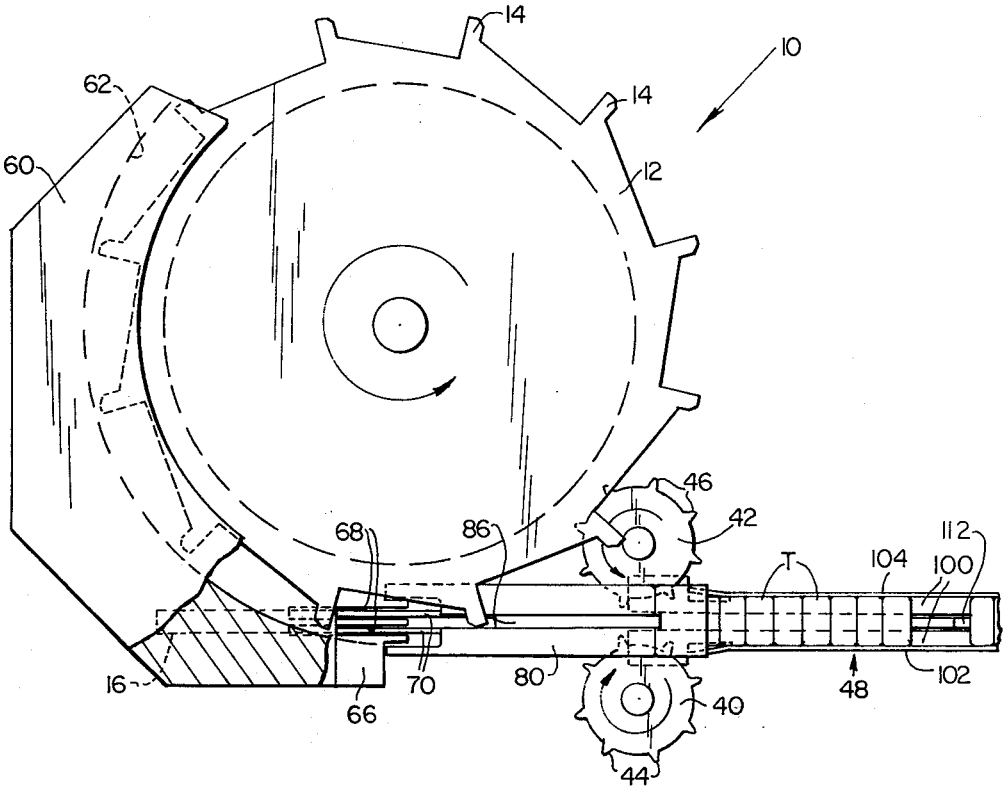
FIG. 3 is a plan view of the high speed stacker also partially in section.

FIGS. 2 and 3 illustrate the high speed stacker 10 in greater detail. A stationary retaining guide 60 circumscribes a portion of the feed wheel 12 and bears an internal groove or track 62 for supporting the tablet and holding the tablet in engagement with the teeth 14 as the tablet moves toward the receiving point at the top of the tumble wheel 16. The track 62 is an arcuate groove cut within the guide 60 between flanges which straddle the teeth 14 along an arcuate segment of the wheel 12. As shown most clearly in FIG. 2, the guide 60 includes a bottom plate 64 which defines a ramp 66 at the end of the track 62 adjacent the tumble wheel 16. As seen in the plan view of FIG. 3 where the pressing wheel is not illustrated, the ramp includes two slots 68 which accommodate two flanges 70 respectively on the periphery of the tumble wheel 16.

The upper side of the guide 60 also includes a notch 72 which allows the teeth 34 on the pressing wheel 30 to enter the track 62 and make contact with the tablets as they reach the ramp 66. In a preferred embodiment of the invention, the teeth 34 on the pressing wheel 30 are driven at a peripheral speed which is slightly higher than the teeth 14 on the feed wheel so that the tablets are not only pressed downwardly into the pockets of the tumble wheel 16 but are also urged forwardly out of contact with the teeth 14 on the feed wheel 12. Thus, there is less likelihood of the tablets becoming jammed as they are transferred between the guide 60 and the tumble wheel 16.

Another stationary retaining guide 80 circumscribes an arcuate portion of the tumble wheel 16 between the receiving point at the top of the wheel and a discharge point located approximately 90° from the top between the stacking wheels 40 and 42. Like the guide 60, the guide 80 has an internal groove defining a track 82 between two flanges 84 which straddle the periphery of the tumble wheel 16 between the receiving and discharge points. It will be noted that the flanges are approximately equal in size to the depth of the pockets 18 so that the tablet is captured within a pocket and must move in an arcuate path through the track 82 with the tumble wheel until it reaches the discharge point. A notch 86 is provided in the upper end of the stationary guide 80 to provide clearance for the teeth 34 of the pressing wheel 30.

It may be desirable to mount the stationary guides 60 and 80 to the fixed frame or other structure which supports the various wheels by means of quick-release catches and the handles. By mounting the guides in this manner, they may be readily removed from the feed wheel 12 and the tumble wheel 16 for cleaning or clearing tablets easily from the stacker.

At the lower end of the track 82 in the retaining guide 80 a resilient finger or leaf spring 90 is mounted by means of a screw 92. The spring 90 holds the tablets in the pockets 18 in the event that the stacker 10 must be stopped when a tablet has almost reached the discharge point. It will be understood that with the discharge point situated 90° from the top of the wheel, gravity could cause a tablet which has almost reached the discharge point to topple out of a pocket and possibly jam the tumble wheel 16 or the stacking wheels 40 and 42 when the stacker is again started up.

It will also be noted in FIGS. 2 and 3 that the axes of the stacking wheels 40 and 42 are situated in a vertical plane which is parallel to the axis of the tumble wheel 16 and generally tangent to the wheel at the discharge point. Furthermore, the teeth 44 and 46 on the stacking wheels are spaced by an amount which is slightly less than the width of a tablet T so that as a pocket 18 containing a tablet rotates between the wheels 40 and 42, the teeth 44 and 46 engage the tablet and pull it out of the pocket toward the stacking tray 48. A stationary finger 96 depending from the bottom edge of the retaining guide 80 deflects the tablet downward should it fail to be positioned on the stacking tray 48 as the tablet is transferred by the wheels 40 and 42.

The stacking tray 48 extends horizontally away from the tumble wheel 16 and defines a support surface 100 on which the tablets are dropped side-by-side in a horizontal stack. In a preferred embodiment of the invention, the stacking tray is comprised of two L-shaped rails 102 and 104 shown most clearly in FIG. 3, each rail having a side wall for holding the stacked tablets in place. The side walls are slightly flared at the in-feed end of the tray adjacent the stacking wheels 40 and 42 to guide the tablets into a centered position on the rails. The bottoms of the rails are situated in the same horizontal plane and thus define separate portions of the support surface 100.

As shown in FIG. 3, the L-shaped rails 102 and 104 are spaced from one another by an amount which is less than the width of a tablet and thusly define a central gap in the support surface 100 through which a conveyor mechanism 110 shown in FIG. 2 projects to move the stacked tablets away from the tumble wheel 16 in multi-tablet groups. The conveyor mechanism illustrated is a hitch feeder which includes a plurality of spaced pushing fingers 112 which advance the respective stacks of tablets along predetermined segments of the support surface 100. The fingers 112 are interconnected with an orbital drive mechanism (not shown) and are orbited in a generally oblong path to push the stacks of tablets to the right in FIG. 2, then drop down below the support surface 100 and return to respective positions behind the succeeding stacks of tablets in a cyclic hitching operation. A more detailed illustration and explanation of a hitch feeder of this type may be had by reference to U.S. Pat. No. 2,276,744 referenced above.

The high speed stacker 10 is capable of processing the tablet-like products at high speeds due to the tangential flow of the products between the feed wheel and the tumble wheel. At the discharge point, the stacking wheels 40 and 42 pull the products out of the pockets 18 and place them in stacks which are translated away from the tumble wheel. The cyclic operation of the hitch-feeder mechanism 110 is synchronized with the rotation of the tumble wheel 16 so that the finger 112 adjacent the tumble wheel 16 is inserted through the support surface 100 between discharges of serially adjacent tablets.

While the present invention has been described in a preferred embodiment, it will be understood that numerous modifications and substitutions can be had without departing from the spirit of the invention. For example, it will be readily understood that the hitch feeder utilized to move the stacked tablets away from the tumble wheel may be replaced by various other types of conveying means. A conveyor belt placed upon the support surface 100 may be substituted for the hitch feeder if division of the stacked tablets is not desired or is accomplished by other equipment with which the stacking equipment operates. It will be understood that various types of feed mechanisms other than the feed wheel 12 may be utilized to deliver the products serially to the pockets of the tumble wheel 16. The tumble wheel and the stacking wheels need not have the precise configuration shown but may take numerous other forms. Accordingly, the present invention has been described in a preferred embodiment by way of illustration rather than limitation.

I claim:

1. A high speed stacker for assembling a group of individual products in series comprising:

input feeding means for feeding the individual products sequentially along a product feed path;

a tumble wheel mounted for continuous rotation about an axis along the product feed path of the input feeding means with the wheel generally tangent to the path at a receiving point, the wheel containing a plurality of product-receiving pockets on the periphery of the wheel, each pocket having a peripheral opening facing radially outwardly for individually receiving a product transmitted along the feed path to the receiving point of the wheel and carrying the individual product about the wheel to a discharge point arcuately displaced from the receiving point;

guide means circumscribing the periphery of the tumble wheel between the receiving point and the discharge point for holding the products in the individual pockets of the wheel during arcuate displacement in the continuously rotated tumble wheel;

a stacking tray projecting away from the tumble wheel at the discharge point on the periphery of the tumble wheel, the tray defining a support surface for holding the products discharged from the tumble wheel in a stack; and two stacking wheels positioned in spaced relationship and at opposite sides of the tumble wheel at the discharge point, the wheels being rotatably driven in opposite directions about parallel axes lying in a plane generally parallel to the axis of rotation of the tumble wheel at the discharge point, and being positioned to engage an individual product in a pocket and pull the product through the peripheral opening of a pocket toward the stacking tray.

2. A high speed stacker as defined in claim 1 further including a pressing wheel rotatably driven about an axis parallel to the axis of the tumble wheel and positioned generally tangent to the tumble wheel at the receiving point to urge the products from the feeding means into the pockets of the tumble wheel.

3. A high speed stacker as defined in claim 2 wherein the input feeding means includes a feed wheel disposed in a plane generally perpendicular to the tumble wheel and the pressing wheel and tangent to the tumble wheel at the receiving point.

4. A high speed stacker as defined in claim 1 further including a drive motor and drive mechanism connected between the motor and the tumble wheel and the stacking wheels to synchronously rotate the wheels.

5. A high speed stacker as defined in claim 1 wherein the parallel axes of the stacking wheels lie in a plane generally tangent to the tumble wheel at the discharge point.

6. A high speed stacker as defined in claim 1 further including conveyor means cooperating with the stacking tray for moving the stacked products away from the discharge point on the tumble wheel.

7. A high speed stacker as defined in claim 6 wherein:

the stacking tray is comprised of split, parallel rails spaced from each other by an amount less than the width of the products stacked on the tray; and the conveyor means includes a pushing finger projecting through the spacing between the parallel rails to engage the stacked products.

8. A high speed stacker as defined in claim 1 wherein:

the tumble wheel is rotatably mounted about a horizontal axis situating the wheel below the product feed path of the feeding means and tangent to the path at a receiving point on the upper portion of the wheel; and the two stacking wheels are positioned at a discharge point located approximately 90° from the top of the tumble wheel and the stacking wheels are rotatably driven about vertical axes at opposite sides of the tumble wheel.

9. A high speed stacker as defined in claim 8 wherein the stacking tray has a horizontal support surface positioned immediately below the two stacking wheels for receiving and holding the discharged products in a stack.

10. A high speed stacker as defined in claim 1 wherein the two stacking wheels have spaced peripheral teeth which are positioned and rotated by the stacking wheel to pull the product from a pocket of the tumble wheel.

* * * * *